United States Patent [19]

Cecchini

[11] 4,112,804

[45] Sep. 12, 1978

[54] STRINGED MUSICAL INSTRUMENT

[76] Inventor: Jack Cecchini, 5344 N. Magnolia, Chicago, Ill. 60640

[21] Appl. No.: 778,941

[22] Filed: Mar. 18, 1977

[51] Int. Cl.[2] ..... G10D 1/00

[52] U.S. Cl. ..... 84/173; 84/291; 84/297 R; 84/314; 84/465

[58] Field of Search ..... 84/173, 263, 267, 284, 84/285, 290, 291, 293, 297–299, 314, 465

[56] References Cited

U.S. PATENT DOCUMENTS

| | | | |
|---|---|---|---|
| 587,089 | 7/1897 | Duck | 84/285 |
| 2,043,121 | 6/1936 | Quemore | 84/314 UX |
| 4,031,801 | 6/1977 | Cecchini | 84/465 |
| 4,041,830 | 8/1977 | Doane | 84/173 |

FOREIGN PATENT DOCUMENTS

| | | | |
|---|---|---|---|
| 18,681 | 12/1904 | Austria | 84/314 |
| 107,577 | 1/1918 | United Kingdom | 84/297 R |

*Primary Examiner*—John Gonzales

*Attorney, Agent, or Firm*—Vogel, Dithmar, Stotland, Stratman & Levy

[57] ABSTRACT

A stringed musical device for teaching purposes in which a sound chamber is provided with an aperture therein; a plurality of longitudinally extending spaced-apart strings are maintained in tension over the aperture. A finger board is removably stored in the sound chamber and in use is positioned intermediate the strings and the surface of the sound chamber to enable left-hand practice. The sound chamber may be utilized for right-hand practice without the finger board or with the finger board in the storage position thereof.

9 Claims, 5 Drawing Figures

STRINGED MUSICAL INSTRUMENT

BACKGROUND OF THE INVENTION

There are many devices for teaching of guitar, mandolin, ukulele or other stringed instruments. One such prior art device is U.S. Pat. No. 2,145,718, issued to A. G. Finney, Jan. 31, 1939, for STRINGED MUSICAL INSTRUMENT, wherein a movable slide is positioned on runners which along with a provided punch card is used to produce particular chords in particular keys of music. Another prior art patent representative of the field, is U.S. Pat. No. 3,218,904, issued to L. M. Hartman, Nov. 23, 1965, for GUITAR TRAINING DEVICE. This patent discloses a training device which is adapted to fit under the strings of a guitar neck and which contains identification for particular chords. Still another prior art device is disclosed in U.S. Pat. No. 3,494,240, issued Feb. 10, 1970, to A. G. Laselva et al., for SOUNDING BOX, in which a hollow box is provided with a single bridge and strings of different diameters to illustrate the physics involved in the production of tones.

All of these devices are adequate for their intended purposes, but none is particularly adapted to provide a teaching device for serious students of string instruments which allows the students to practice left-hand fingering and also right-hand strumming or plucking.

SUMMARY OF THE INVENTION

This invention relates to a device for practicing both left-hand fingering and right-hand strumming or plucking.

It is an important object of the present invention to provide a device which is compact and which may be used for strumming or plucking, while producing a sound comparable to a full-size stringed instrument or may be used for left-hand fingering without producing any substantial tone.

Another object of the present invention is to provide a sound chamber having an aperture therein, a plurality of longitudinally extending and transversely spaced-apart strings extending over the aperture, stop means for fixedly securing one end of the strings near one end of the sound chamber, tensioning means connected to the other end of the strings near the other end of the sound chamber for adjusting the tension in the strings across the aperture, and bridge means intermediate the stop means and the tensioning means for maintaining the strings a sufficient distance away from the sound chamber to accommodate a finger board between the sound chamber and the strings.

A further object of the present invention is to provide a string device comprising a sound chamber having an aperture therein, a plurality of longitudinally extending and transversely spaced-apart strings extending over the aperture, stop means for fixedly securing one end of the strings near one end of the sound chamber, tensioning means connected to the other end of the strings near the other end of the sound chamber for adjusting the tension in the strings across the aperture, bridge means intermediate the stop means and the tensioning means for maintaining the strings a sufficient distance away from the sound chamber to accommodate a finger board between the sounding chamber and the strings, a removable finger board having frets extending thereacross for placement between the sound chamber and the strings, and means on the finger board for frictionally engaging the bridge means to maintain the finger board in place during left-hand practice.

These and other objects of the present invention may more readily be understood by reference to the following specification taken in conjunction with the drawings, in which:

DESCRIPTION OF THE PREFERRED EMBODIMENT

Figure 1:
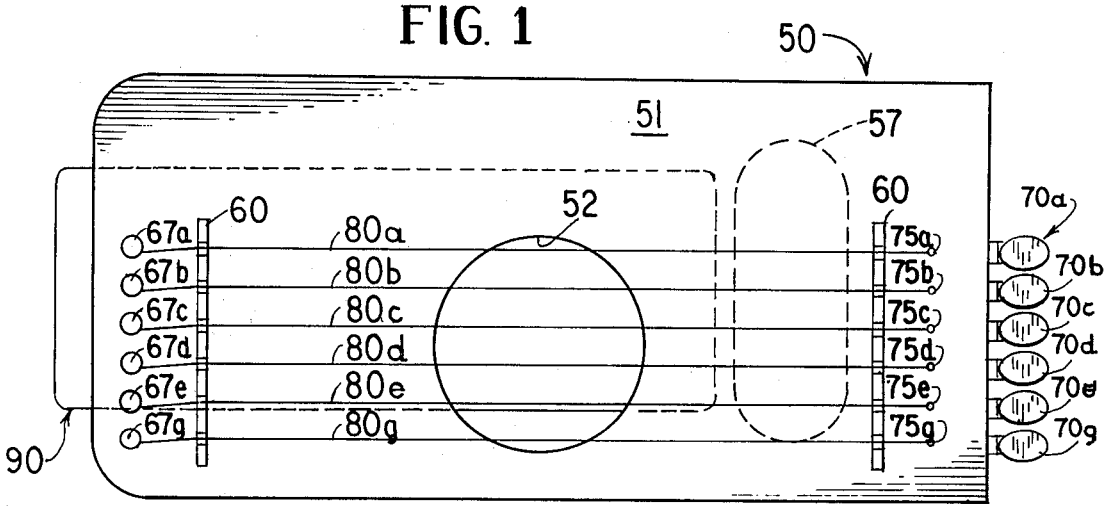
FIG. 1 is a top elevational view of the stringed device of the present invention showing the finger board in the storage position thereof.

Referring now to the drawings, there is shown a device 50 which is substantially box-shaped and includes a flat top surface 51 having a round aperture 52 centrally disposed therein. The device 50 includes upstanding end walls 54 and 55 interconnected by a bottom wall 56 and upstanding side walls 59. The side walls 59, the bottom wall 56 and the end walls 54 and 55, may be of unitary construction. The top surface or wall 51 is secured by any suitable means to the other enumerated side walls 59 and end walls 54, 55.

A elongated opening 57 is provided in the rear wall 56 near the end wall 54, the opening 57 being elliptical in shape and of sufficient size to allow entry of a user's hand therein. A slot 58 is positioned in the end wall 55 adjacent the bottom wall 56 and has a predetermined width for a reason hereinafter set forth.

Two spaced-apart bridges 60 upstand from the top surface 51 a predetermined distance, the bridges 60 extending in a plane normal to the plane of the surface 51, the bridges preferably extending away from the surface 51 the same amount. Inside the box formed by the aforementioned sides, ends, top and bottom walls, there is positioned two spaced-apart rails 63 and 64, with an end stop 62 being positioned near the grip opening 57 all for purposes hereinafter set forth.

Six pegs **67*a* through 67*g* are positioned in the top surface 51 adjacent the end wall 55, the pegs 67 forming a plane normal to the longitudinally extending axis of the device 50. Six machine heads 70*a* through 70*g* are positioned at the other end 54 of the device 50, and are aligned respectively with the pegs 67*a* through 67*g*. Each of the machine heads 70*a* through 70*g* includes finger grip 71 connected to a shaft 72 extending through a boss 73 formed on the inside of the end wall 54. The apertures in the boss 54 are fitted such that there is frictional engagement between the shafts 72 and the boss 73, thereby to retain the machine heads in their position when the machine heads 70 are rotated to a preselected position, thereby to maintain a predetermined tension in a string 82**.

A plurality of small apertures **75*a* through 75*g* are respectively positioned in alignment with the corresponding machine heads 70*a–g* and the pegs 67*a–g* to facilitate the positioning of a corresponding string 80*a* through 80*g* through the corresponding apertures 75*a–g*** to the associated machine heads 70*a–g*. Specifically, there are six apertures 75*a–g* forming a plane normal to the longitudinally extending axis of the device 50, each aperture 75 forming a plane with the associated peg 67 parallel to the longitudinal axis of the device 50. The machine heads 70*a–g* are used in conjunction with the associated pegs 67*a–g* to provide any desired tension in the strings 80*a–g*.

Figure 2:
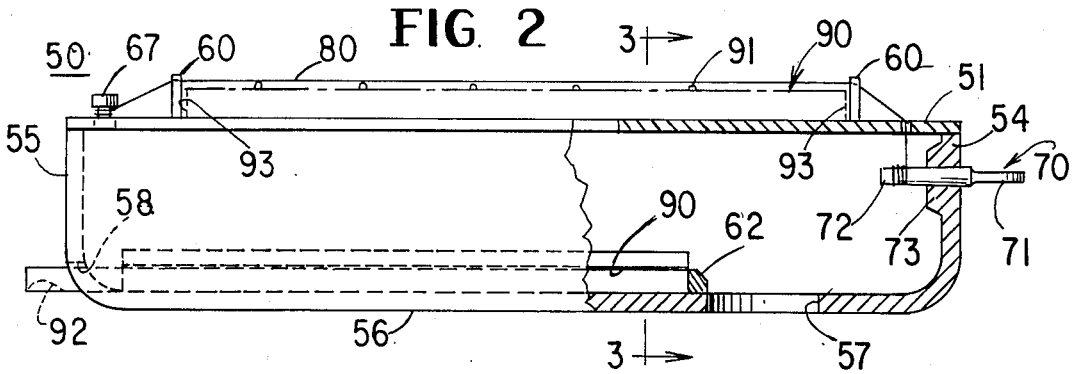
FIG. 2 is a side view partly in section of the device illustrated in FIG. 1.
Figure 4:
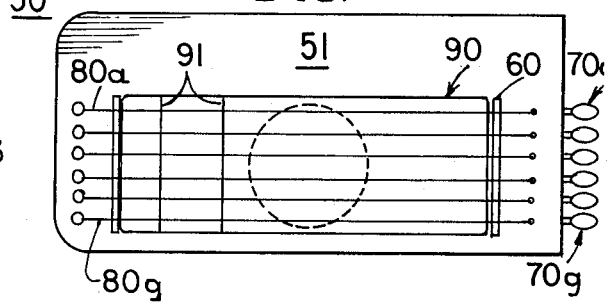
FIG. 4 is a top elevational view of the device shown in FIG. 1, with the finger board in place.
Figure 5:
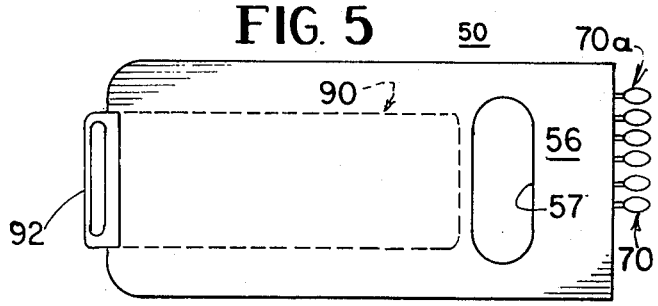
FIG. 5 is a rear elevational view of the device shown in FIG. 1, with finger boards in the storage position thereof.

A finger board 90 is provided with a plurality of transversely extending longitudinally spaced-apart frets 91, one end of the finger board having a handle 92 therein. The finger board 90 is constructed and arranged to fit in the slides 63 and 64, and to be retained therein during use of the device 50 for plucking and strumming. The finger board 90 is constructed and arranged to fit, as particularly seen in FIG. 4, and in phantom in FIG. 2, intermediate the bridges 60 and to that end, there are provided bumpers 93 on the side edges of the finger board 90 frictionally to engage the associated bridge 60, thereby to maintain the finger board 90 in position during practice of fingering or left-hand playing.

Figure 3:
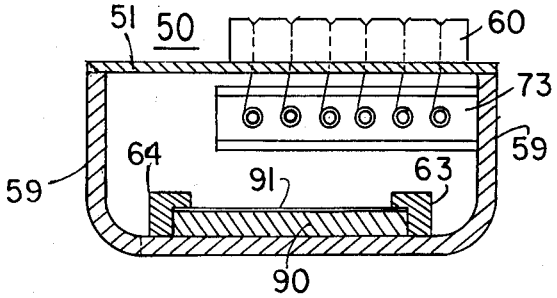
FIG. 3 is an end sectional view of the device illustrated in FIG. 2, as seen along the line 3—3 thereof.

In use, the device 50 may be used to practice right-hand playing consisting of plucking and strumming when the finger board 90 is in the storage position thereof as shown in FIGS. 1 and 3. When used in this fashion, the device 50 is tuned in accordance with any desired musical instrument, such as a guitar, mandolin, violin or the like, and the plucking or strumming is practiced using only the device as illustrated. When it is desired to practice left-hand technique, or fingering, then the finger board 90 is removed from the storage position thereof and inserted intermediate the top surface 51 and the strings 80*a–g*, the board 90 being maintained in place by bumpers 93 in frictional engagement with the associated bridges 60. In this position, the frets 91 lie closely adjacent to the associated strings 80*a–g*, thereby to permit normal practicing of fingering technique.

Due to the relatively large sound box provided in the present invention, plucking or strumming produces a relatively high quality tone thereby enabling the user to hear clearly the results of his right-hand practice technique, but since the overall dimensions of the device 50 are much less than a normal guitar or violin, the device lends itself to practice during car trips and the like. The hand grip 57 facilitates the holding of the device 50 during the practice of the strumming or plucking and also facilitates the stringing of the device.

As is clear from the foregoing description, the device 50 particularly the walls 51, 54, 55, 56 and 59, may be made of wood or plastic, whereas the strings 80 may be made of steel or nylon. The finger board 90 may be made of any suitable material such as plastic or wood. The machine heads 70 are standard in the art and may be located as shown or may be upstanding from the surface 51 in the manner of the pegs 67. The pegs 67 may be fitted into an aperture in the top surface 51 or may be permanently mounted to the top surface 51. The bridges 60 preferably extend away from the surface 51 the same distance and are provided with six notches therein to facilitate placement of strings thereacross. The device 50 may easily be adapted to practice 12 string guitar or any other stringed instrument which is plucked and fingered.

While there has been described what is considered to be the preferred embodiment of the present invention, it will be recognized that certain modifications and alterations may be made therein without altering the spirit and scope of the present invention, and it is intended to cover all such modifications and alterations in the appended claims.

What is claimed is:

1. A stringed device, comprising a sound chamber having a first aperture therein, a plurality of longitudinally extending and transversely spaced-apart strings extending over said first aperture, stop means for fixedly securing one end of said strings near one end of said sound chamber, tensioning means connected to the other end of said strings near the other end of said sound chamber for adjusting the tension in said strings across said aperture, a second aperture in said sound chamber in the rear thereof sized to facilitate operation of said tensioning means and to provide a grip for holding the device, and bridge means intermediate said stop means and said tensioning means for maintaining said strings a sufficient distance away from said sound chamber to accommodate a finger board between said sound chamber and said strings.

2. The stringed device set forth in claim 1, wherein said stop means are a plurality of pegs frictionally engaged in apertures in said sound chamber.

3. The stringed device set forth in claim 1, wherein said tensioning means are a plurality of machine heads extending outwardly from said other end of said sound chamber.

4. The stringed device set forth in claim 1, wherein said bridge means extend away from said sound chamber the same distance.

5. The stringed device set forth in claim 3, wherein said machine heads extend into said sound chamber and a plurality of apertures corresponding in number to said machine heads in said sound chamber facilitate the threading of said strings onto said machine heads.

6. A stringed device, comprising a sound chamber having an aperture therein, a plurality of longitudinally extending and transversely spaced-apart strings extending over said aperture, stop means for fixedly securing one end of said strings near one end of said sound chamber, tensioning means connected to the other end of said strings near the other end of said sound chamber for adjusting the tension in said strings across said aperture, bridge means intermediate said stop means and said tensioning means for maintaining said strings a sufficient distance away from said sound chamber to accommodate a finger board between said sound chamber and said strings, a removable finger board having frets extending thereacross for placement between said sound chamber and said strings, and means on said finger board for frictionally engaging said bridge means to maintain said finger board in place during left-hand practice.

7. The stringed device set forth in claim 6, wherein there is provided storage means in said sound chamber to store said finger board when not in use.

8. The stringed device set forth in claim 7, wherein said sound chamber has a slot in one end thereof sized to accept said finger board and slides in said sound chamber interior to provide storage for said finger board.

9. The stringed device set forth in claim 7, wherein said finger board has a handle on one end thereof to facilitate easy movement between the storage and use portions thereof.

* * * * *